US007000904B2

(12) United States Patent
Huang

(10) Patent No.: US 7,000,904 B2
(45) Date of Patent: Feb. 21, 2006

(54) CABLE WINCH STRUCTURE

(76) Inventor: Yuan-Hsiang Huang, PO Box 82-144, Taipei (TW)

( * ) Notice: Subject to any disclaimer, the term of this patent is extended or adjusted under 35 U.S.C. 154(b) by 0 days.

(21) Appl. No.: 10/861,423

(22) Filed: Jun. 7, 2004

(65) Prior Publication Data

US 2005/0279978 A1 Dec. 22, 2005

(51) Int. Cl.
*B66D 1/00* (2006.01)

(52) U.S. Cl. ..... 254/323; 254/344; 254/345; 254/346

(58) Field of Classification Search ..... 254/344, 254/323, 345, 346

See application file for complete search history.

(56) References Cited

U.S. PATENT DOCUMENTS

| | | | | | |
|---|---|---|---|---|---|
| 2,924,430 | A * | 2/1960 | Smith et al. | ..... | 254/344 |
| 3,265,362 | A * | 8/1966 | Moody | ..... | 254/343 |
| 4,452,429 | A * | 6/1984 | Muessel | ..... | 254/344 |
| 4,461,460 | A * | 7/1984 | Telford | ..... | 254/344 |
| 4,736,929 | A * | 4/1988 | McMorris | ..... | 254/344 |
| 5,692,735 | A * | 12/1997 | Aho et al. | ..... | 254/323 |
| 6,663,806 | B1 * | 12/2003 | Howell et al. | ..... | 264/103 |

* cited by examiner

*Primary Examiner*—Emmanuel Marcelo
(74) *Attorney, Agent, or Firm*—Leong C. Lei

(57) ABSTRACT

A cable winch structure for vehicles is disclosed. The cable winch includes a rolling cylinder connected to a speed-reducing device at one lateral side, and having a motor connected to one end of the roller cylinder so that the speed reducing motor transmits the power of the motor to the roller cylinder facilitating traction of the cable and the speed-reducing device.

1 Claim, 7 Drawing Sheets

CABLE WINCH STRUCTURE

BACKGROUND OF THE INVENTION (a) Technical Field of the Invention

The present invention relates to a cable winch for vehicles, and in particular, to an improved structure of a cable winch with respect to the structure of planetary gear and clutching planetary gear, wherein the cable winch is rigid and secured.

(b) Description of the Prior Art

U.S. Pat. No. 6,663,086 entitled "Structure of a Cable Winch Used in Vehicle" issued to the present applicant discloses, as shown in FIG. 1, a cable winch having a rolling cylinder component 20 having one end being mounted with a gear speed-reducing device 30 and the other end being mounted with a motor 40 so as to transmit the power of the motor 40 to the rolling cylinder component 20 by the gear speed-reducing device 30 allowing the rolling up of the cable 21. The gear speed-reducing device includes a control button 31, a transmission shaft 32, a gear box 33, a sun gear 34, a plurality of planetary gear sets, a clutch and planet gear set 36 and a fastening ring 37.

One end of the transmission shaft 32 is inserted into the inner hole 312 of the control button 31 and a fastening ring 321 is used to fasten. The tubular section 311 of the control button 31 is pivotally inserted into the through hole 332 position of the gear box 33 and the protruded peg 313 is matched to the recess 333 of the gear box 33. The transmission shaft 32 is mounted at the center of the gear box 33 and the transmission shaft 32 of the gear box 33 is then mounted in sequence with a corrugated pad 38, sun gear 34, a plurality of planetary gear set 35 and the clutch and planet gear set 36. A fastening ring 37 is used to fasten the moving gear 363 at the recess 322 of the transmission shaft 32. The sun gear 34 and the planetary gear set 35 and the clutch and planet gear 36 can accept the input power from the transmission shaft 32, and the planetary gear set 35 and the clutch and planet gear set 36 are in engagement and driven with the inner circular teeth 331 of the gear box 33 to form planetary gear-reducing device 30. The gear box 33 is locked at one end of the rolling cylinder 20 with screw bolt 334 and the moving gear 363 of the clutch and planet gear set 36 is in engagement with the teeth portion 23 of the rolling cylinder 22, and the transmission shaft 32 passes through the rolling cylinder 22. The other end of the rolling cylinder 20 is pivotally mounted to the rotating shaft 41 of the mounted with a corrugated pad and a seal 44 and a screw bolt 43 is used to lock the motor 40 to the other end of the rolling cylinder 20 and the insertion hole 42 of the rotating shaft 41 is in engagement with the end terminal of the transmission shaft 32 and obtain power output from the motor 40.

SUMMARY OF THE INVENTION

Accordingly, it is an object of the present invention to provide a cable winch structure having a rolling cylinder connected to a speed-reducing device at one lateral side, and having a motor connected to one end of the roller cylinder so that the speed reducing motor transmits the power of the motor to the roller cylinder facilitating traction of the cable and the speed-reducing device including an control button, a transmission shaft, a gear box, sun gear, a predetermined planetary gear component on a base plate, a clutching gear module on a base plate and fastening rim, characterized in that the perimeter edge of the planetary gear component base plate is an integral unit perpendicularly folded to form a plurality of bridging upright faces, and a covering plate provided to the planetary gear component has perimeter edge stamped to form a plurality of recessed slots, in combination the upright faces engage with the recessed slots and then welded to enhance the strength of combination of the planet gear module the perimeter edge of the clutching planetary gear component base plate is an integral unit perpendicularly folded to form a plurality of bridging upright faces, and a covering plate provided to the clutching planet module has perimeter edge which stamped to form a plurality of recessed slots, in combination the upright faces engage with the recessed slots and then welded to enhance the strength of combination of the clutching planetary gear component to provide rigid structure of the cable winch for automobiles.

Another object of the present invention is to provide a cable winch structure for vehicle, wherein the edge of the base plate of the planetary gear component is a plurality of bridging upright surface to match with the plurality of recessed slots of the covering plate, and the bridging upright surface is mounted onto the recessed slots which are welded together to provide a secured structure.

A further object of the present invention is to provide a cable winch structure, wherein the edge of the base plate of the planetary gear component is a plurality of bridging upright surface to match with the plurality of recessed slots of the covering plate, and the bridging upright surface is mounted onto the recessed slots which are welded together to avoid dislocation of the planetary gear component and the front covering of the clutch and planetary gear component when the cable pulls a load or a vehicle.

The foregoing object and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENTS

The following descriptions are of exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

Figure 1:
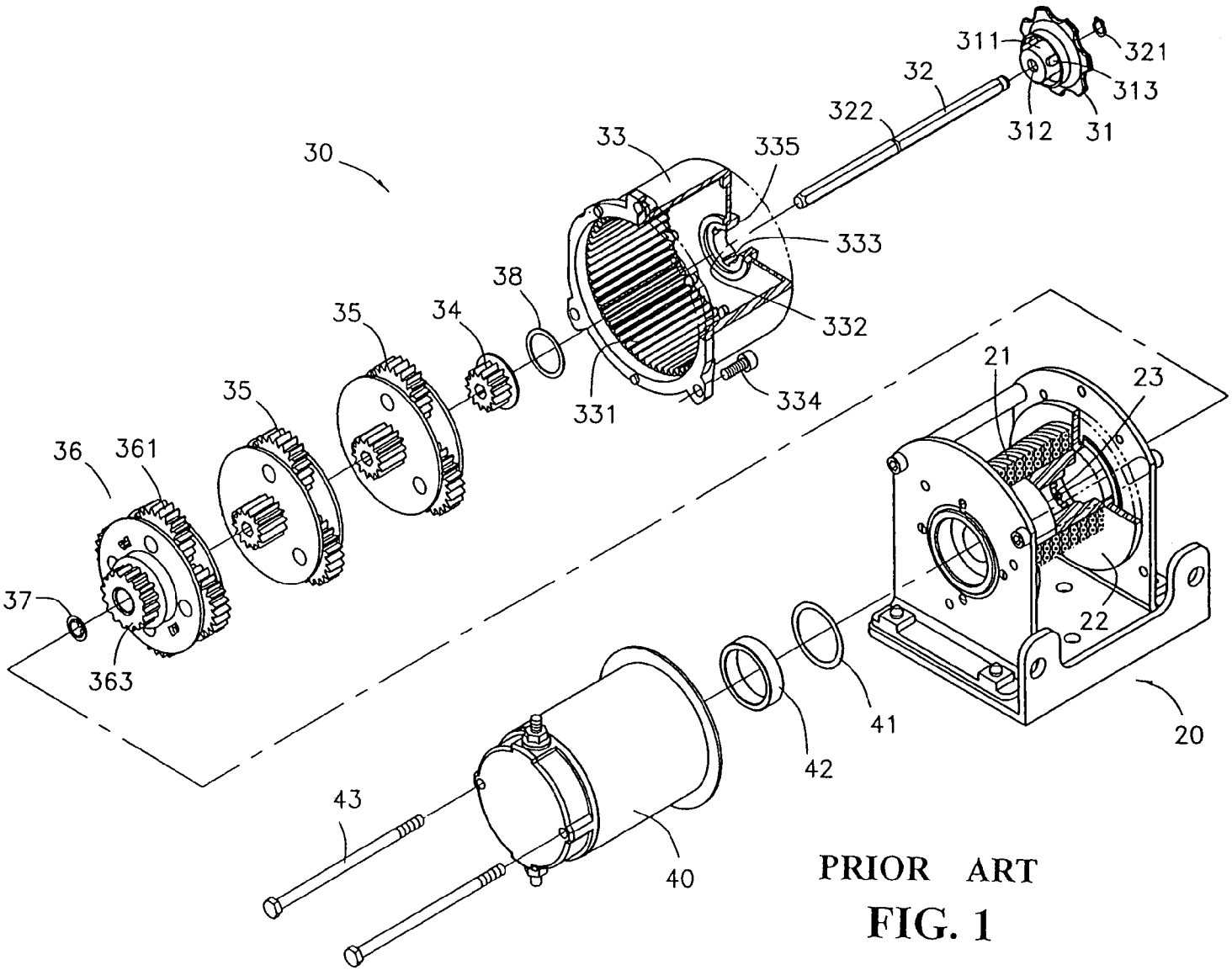
PRIOR ART FIG. 1
FIG. 1 is a perspective exploded view of a winch structure of U.S. Pat. No. 6,663,086.
Figure 2:
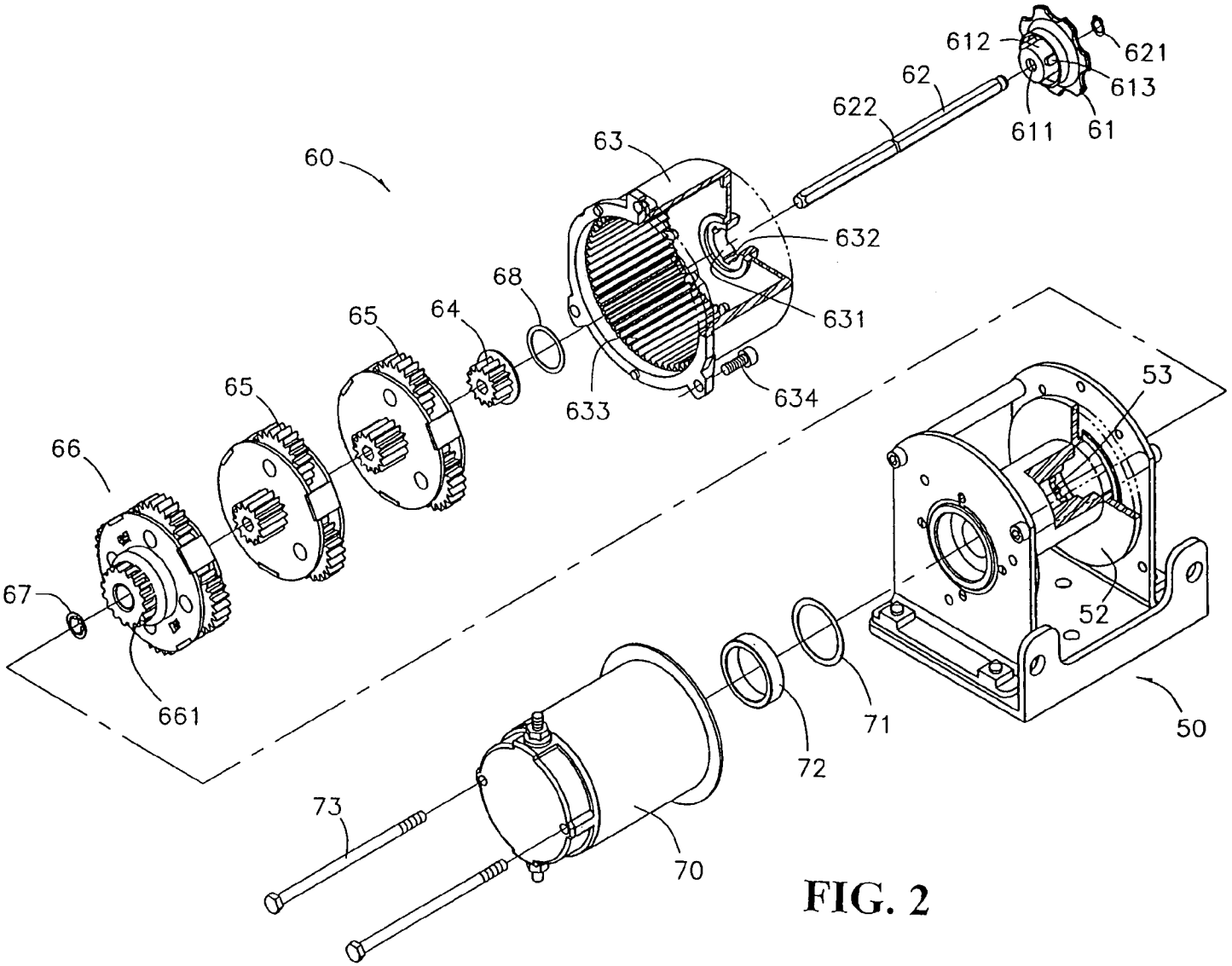
FIG. 2 is a perspective exploded view of the cable winch of the present invention.
Figure 3:
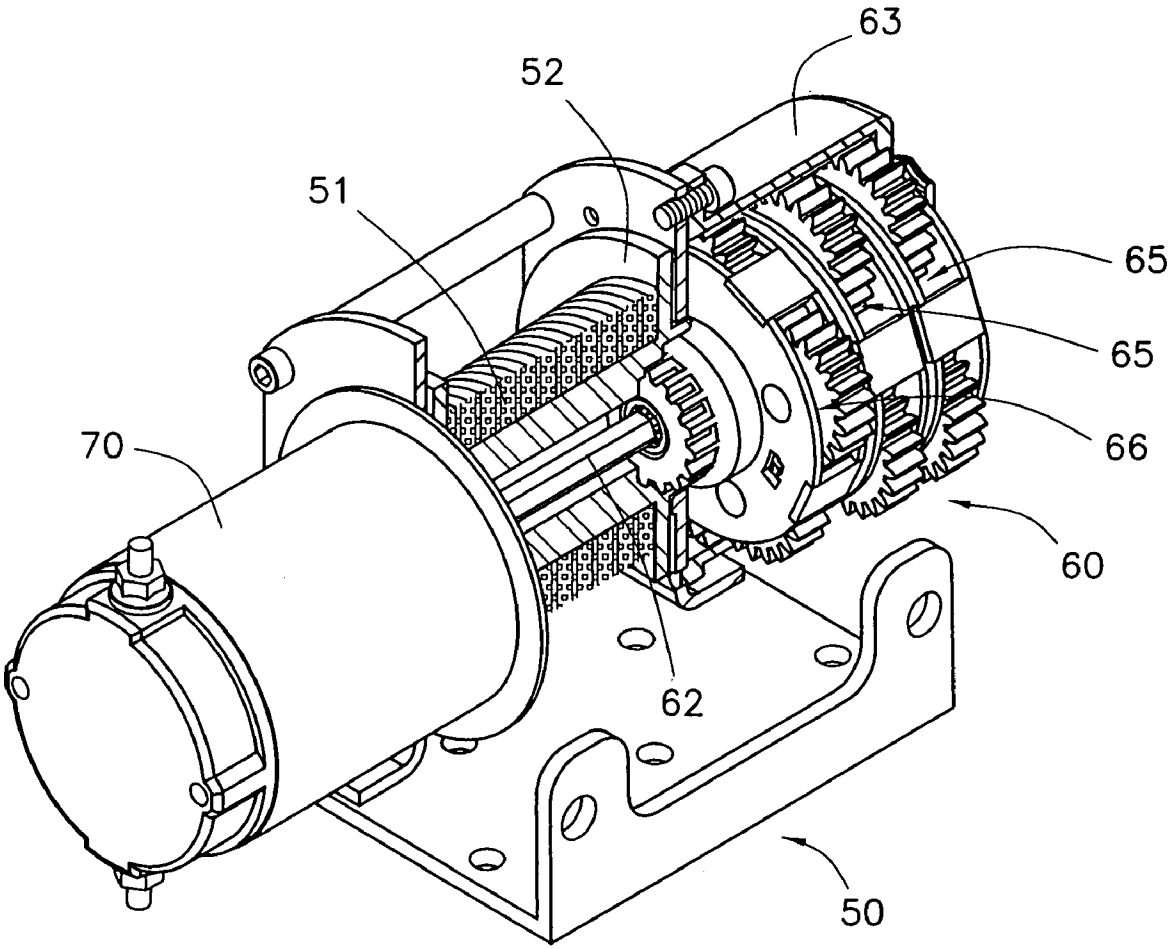
FIG. 3 is a sectional view of a partial winch of the present invention.

Referring to FIGS. 2 and 3, there is shown a cable winch structure for vehicle having a rolling cylinder component 50 with one side pivotally mounted to a speed-reducing device 60. The other end of the rolling cylinder component 50 is connected to a motor 70 so as to transmit power of the motor 70 to the rolling cylinder component 50 by the speed-reducing device 60 so as to appropriately wind-up the cable 51. The speed-reducing device 60 has a control button 61, a transmission shaft 62, a gear box 63, sun gear 64, a plurality of planetary gear component 65, clutch and planetary gear component 66 and a fastening rim 67. One end of the transmission shaft 62 is inserted into the inner hole 611 of the control button 61 and is then fastened by the fastening rim 621. The tubular section 612 of the control button 61 is pivotally mounted at the through hole 631 of the gear box 63, and the peg 613 of the control button 61 is aligned with the recess 632 of the gear box 63. The transmission shaft 62 is inserted into the center of the gear box 63, and the transmission shaft 62 of the gear box 63 is mounted with a corrugated pad 68, the sun gear 64, a plurality of planetary gear components 65 and the clutch and planetary gear components 66. The fastening rim 67 is fastened at the recess 622 of the transmission shaft 62 so as to pivotally secure the top face of the actuating gear 661 of the clutch and planetary gear component 66, and at the same time, the above components are mounted, and the sun gear 64 and various planetary gear component 65 and the clutch and the planetary gear component 66 can accept the power input of the transmission shaft 62. The planetary gear component 65 and the clutch and planetary gear component 66 are engagedly transmitting with the inner rim gear 633 of the gear box 63, forming into planetary gear speed-reducing device 60. The gear box 63 is locked to one end of the rolling cylinder 50 with bolt 634 and the actuating gear 661 of the clutch and planetary gear component 66 is in engagement with the gear section 53 of the rolling cylinder 52. The transmission shaft 62 passes through the rolling cylinder 52. The other end of the rolling cylinder component 50 is pivoted to the rotating shaft of the motor 70 by means of corrugated pad 71 and the pad 72. Nut 73 locks the motor 70 at the other end of the rolling cylinder component 50 and the insertion hole of the rotating shaft engages with the end of the transmission shaft 62 so that the power output of the motor 70 is obtained.

Figure 4:
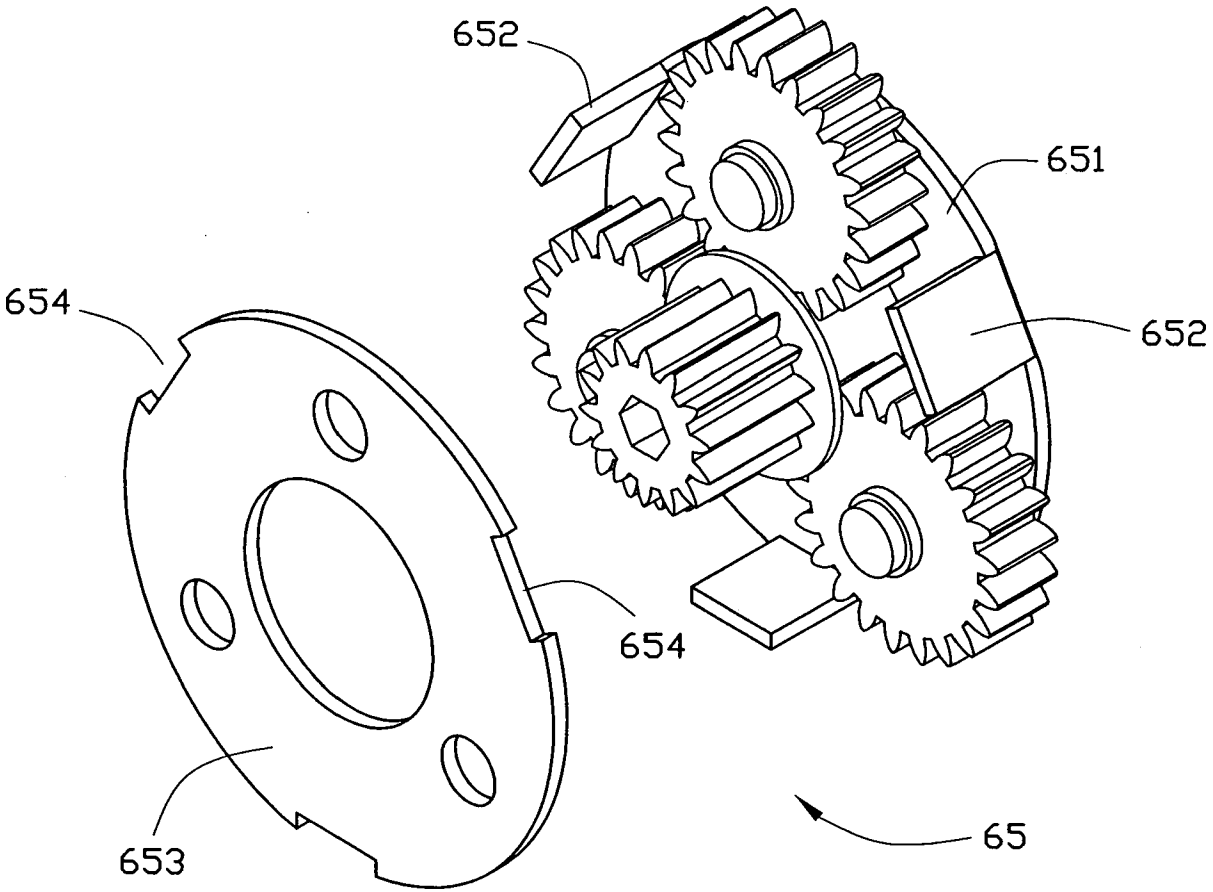
FIG. 4 is a perspective exploded view of the planetary gear of the present invention.
Figure 5:
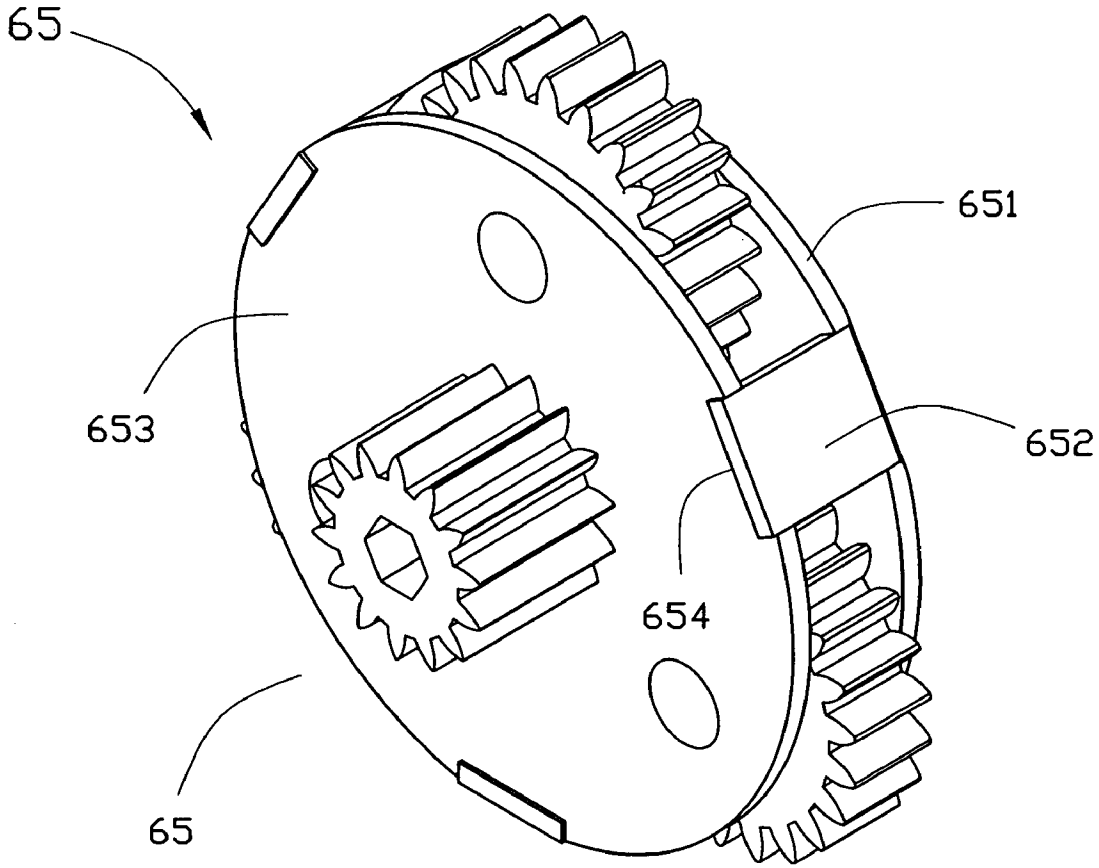
FIG. 5 is a perspective view of the planetary gear of the present invention.

Referring to FIGS. 4 and 5, the perimeter edge of the planetary gear component 65 base plate 651 is an integral unit perpendicularly folded to form a plurality of bridging upright faces, and the covering plate 653 of the planetary gear component has perimeter edge stamped to form a plurality of recessed slots 654. When in combination, the upright faces 652 are engaged with the recessed slot 654 and are then welded to enhance the strength of the combination.

Figure 6:
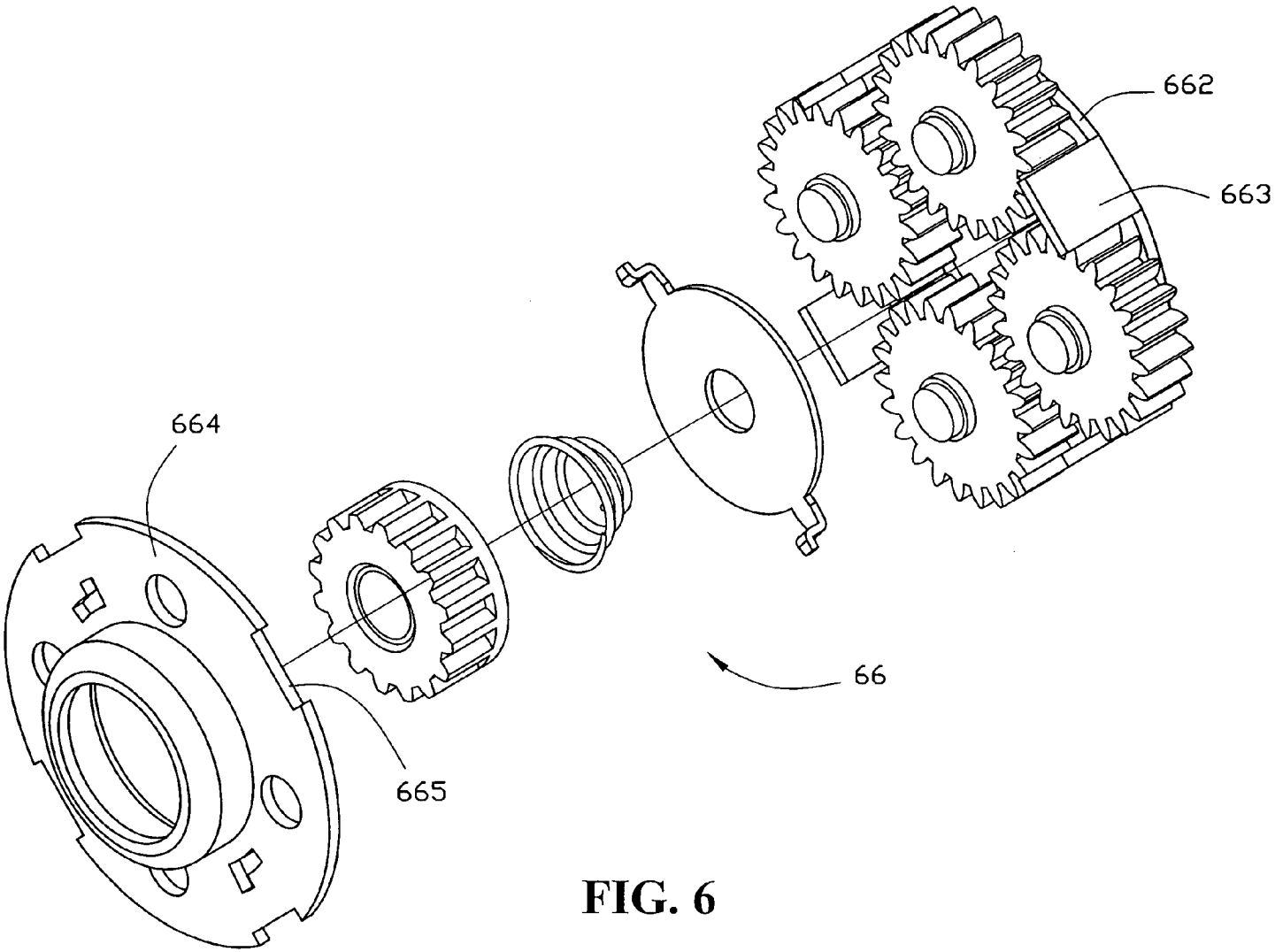
FIG. 6 is an exploded perspective view of the planetary gear of the present invention.
Figure 7:
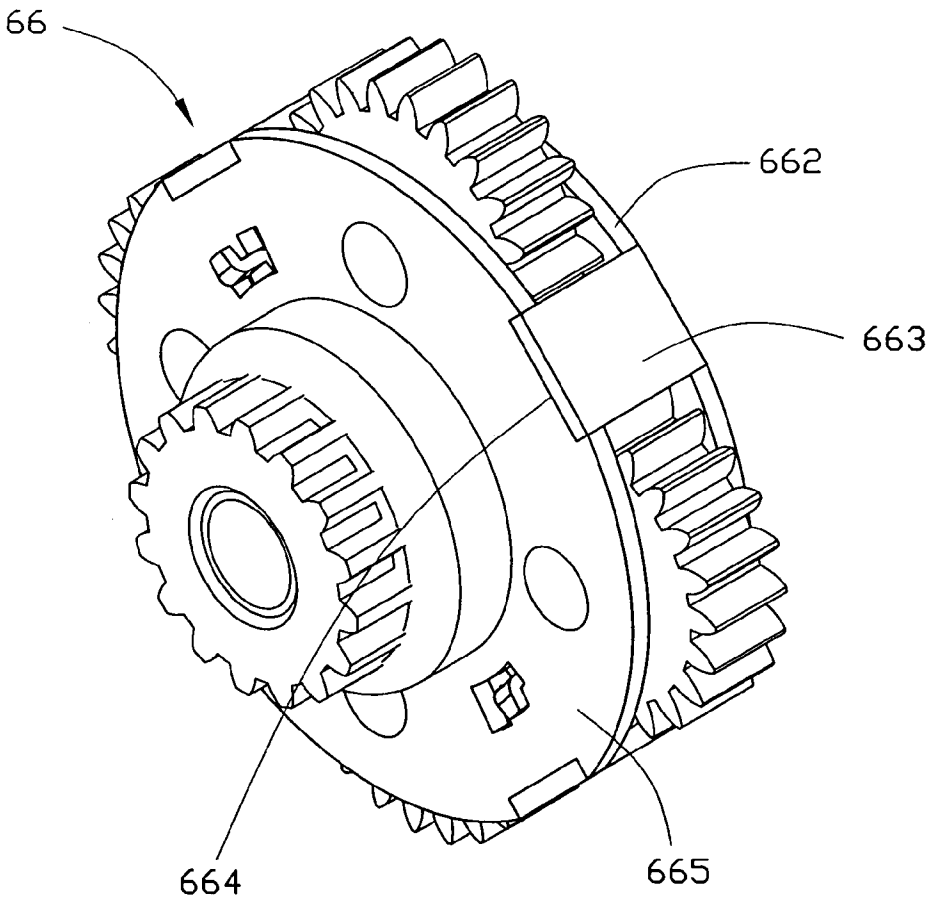
FIG. 7 is a perspective view of the clutching gear of the present invention.

Referring to FIGS. 6 and 7, the perimeter edge of the clutch and planetary gear component 66 base plate 662 is an integral unit perpendicularly folded to form a plurality of bridging upright faces 663, and a covering plate 664 is provided to the clutch and planetary gear component and has perimeter edge which stamped to form a plurality of recessed slots 665. When in combination, the upright faces 663 are in engaged with the recessed slots 665 and are then welded to enhance the strength of the combination of the clutch and planetary gear component 66 to provide a strong combination.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

I claim:

1. A cable winch structure for automobiles having a rolling cylinder connected to a speed-reducing device at one lateral side, and having a motor connected to one end of the roller cylinder so that the speed reducing device transmits power of the motor to the roller cylinder facilitating traction of a cable, the speed-reducing device including a control button, a transmission shaft, a gear box, a sun gear, a predetermined planetary gear component, a clutch and planetary gear component and a fastening rim, wherein a perimeter edge of a base plate of the planetary gear component is an integral unit perpendicularly folded to form a plurality of bridging upright faces, and a covering plate provided to the planetary gear component has a perimeter edge stamped to form a plurality of recessed slots, in combination the upright faces, engaged with the recessed slots and then welded to enhance strength of the combination of the planetary gear component, a perimeter edge of a base plate of the clutch and planetary gear component is an integral unit perpendicularly folded to form a plurality of bridging upright faces, and a covering plate provided to the clutch and planetary gear component has perimeter edge stamped to form a plurality of recessed slots, in combination the upright faces, engaged with the recessed slots and then welded to enhance strength of the combination of the clutch and planetary gear component to provide rigid structure of the cable winch.

* * * * *